US005733698A

United States Patent [19]

Lehman et al.

[11] Patent Number: 5,733,698

[45] Date of Patent: Mar. 31, 1998

[54] RELEASE LAYER FOR PHOTORECEPTORS

[75] Inventors: Gaye K. Lehman, Lauderdale; Claire A. Jalbert, Cottage Grove; Edward J. Woo, Woodbury; Kathryn R. Bretscher, Minneapolis, all of Minn.; James A. Baker, Hudson, Wis.; Mark C. Berens, Oakdale, Minn.

[73] Assignee: Minnesota Mining and Manufacturing Company, St. Paul, Minn.

[21] Appl. No.: 724,073

[22] Filed: Sep. 30, 1996

[51] Int. Cl.[6] ..... G03G 5/147

[52] U.S. Cl. ..... 430/66; 430/126

[58] Field of Search ..... 430/126, 60, 66, 430/67

[56] References Cited

U.S. PATENT DOCUMENTS

| | | | |
|---|---|---|---|
| Re. 31,727 | 11/1984 | Eckberg | 428/429 |
| 4,389,473 | 6/1983 | Scrutton et al. | 430/17 |
| 4,551,406 | 11/1985 | Schaedlich et al. | 430/119 |
| 4,600,673 | 7/1986 | Hendrickson et al. | 430/66 |
| 4,609,574 | 9/1986 | Keryk et al. | 427/407 |
| 4,657,419 | 4/1987 | Takakuwa | 400/490 |
| 4,764,448 | 8/1988 | Yoshitomi et al. | 430/120 |
| 4,804,607 | 2/1989 | Atsumi | 430/67 |
| 4,850,838 | 7/1989 | Wagner et al. | 425/101 |
| 4,933,247 | 6/1990 | Osawa et al. | 430/66 |
| 5,069,993 | 12/1991 | Robinette et al. | 430/58 |
| 5,099,256 | 3/1992 | Anderson | 346/1.1 |
| 5,162,183 | 11/1992 | Lindblad et al. | 430/59 |
| 5,166,021 | 11/1992 | Odell et al. | 430/59 |
| 5,166,023 | 11/1992 | Harada et al. | 430/62 |
| 5,187,039 | 2/1993 | Meyer | 430/126 |
| 5,204,201 | 4/1993 | Schank et al. | 430/59 |
| 5,208,127 | 5/1993 | Terrell et al. | 430/59 |
| 5,212,041 | 5/1993 | Wanat | 430/143 |
| 5,212,048 | 5/1993 | Lewis et al. | 430/272 |
| 5,213,928 | 5/1993 | Yu | 430/66 |
| 5,238,787 | 8/1993 | Haluska et al. | 430/325 |
| 5,240,801 | 8/1993 | Hayashi et al. | 430/57 |
| 5,242,776 | 9/1993 | Doi et al. | 430/67 |
| 5,260,157 | 11/1993 | Mizuta et al. | 430/66 |
| 5,272,029 | 12/1993 | Sakai et al. | 430/58 |
| 5,320,923 | 6/1994 | Nguyen | 430/78 |
| 5,344,733 | 9/1994 | Suzuki et al. | 430/58 |
| 5,385,797 | 1/1995 | Naganara et al. | 430/67 |
| 5,468,815 | 11/1995 | Boardman et al. | 525/478 |

FOREIGN PATENT DOCUMENTS

| | | |
|---|---|---|
| 0243726 | 11/1987 | European Pat. Off. . |
| 0559575 | 9/1993 | European Pat. Off. . |
| 0611999 | 8/1994 | European Pat. Off. . |
| 0632333 | 1/1995 | European Pat. Off. . |
| 0674234 | 9/1995 | European Pat. Off. . |
| 2139564 | 5/1990 | Japan . |
| 2144550 | 6/1990 | Japan . |
| 2201450 | 8/1990 | Japan . |
| 3062039 | 3/1991 | Japan . |
| 3071146 | 3/1991 | Japan . |
| 3135576 | 6/1991 | Japan . |
| 3188452 | 8/1991 | Japan . |
| 4060641 | 2/1992 | Japan . |
| 4120551 | 4/1992 | Japan . |
| 4122945 | 4/1992 | Japan . |
| 4204541 | 7/1992 | Japan . |
| 4278958 | 10/1992 | Japan . |
| 4281460 | 10/1992 | Japan . |
| 4304460 | 10/1992 | Japan . |
| 4324457 | 11/1992 | Japan . |
| HEI 4-346356 | 12/1992 | Japan . |
| 5265243 | 10/1993 | Japan . |
| 5307267 | 11/1993 | Japan . |
| 5341551 | 12/1993 | Japan . |
| 6308756 | 11/1994 | Japan . |
| 6332217 | 12/1994 | Japan . |
| 7134435 | 5/1995 | Japan . |
| 8076388 | 3/1996 | Japan . |

*Primary Examiner*—John Goodrow

*Attorney, Agent, or Firm*—Gary L. Griswold; Walter N. Kirn; Susan Moeller Zerull

[57] ABSTRACT

The invention is photoconductor construction comprising a release layer which controls the carrier liquid on the surface of the photoreceptor and minimizes beading of toner carrier liquid. According to one embodiment this invention is a photoconductor construction comprising a photoconductor layer applied to an electroconductive substrate, an interlayer applied to the photoconductor layer, and a release layer over the interlayer. The release layer is a swellable polymer. According to another embodiment this invention is a photoconductor construction comprising a polymeric release layer that has a surface with an average roughness, Ra, of at least 10 nm.

19 Claims, No Drawings

RELEASE LAYER FOR PHOTORECEPTORS

FIELD OF THE INVENTION

The present invention relates to a photoconductor element (also referred to as a photoreceptor) which is capable of transferring toner images, especially those formed from a liquid toner, to a receptor. More specifically, this invention relates to a release coating for the photoconductor element.

BACKGROUND OF THE INVENTION

Electrophotography forms the technical basis for various well known imaging processes, including photocopying and some forms of laser printing. The basic electrophotographic process involves placing a uniform electrostatic charge on a photoconductor element, imagewise exposing the photoconductor element to activating electromagnetic radiation, also referred to herein as "light", thereby dissipating the charge in the exposed areas, developing the resulting electrostatic latent image with a toner, and transferring the toner image from the photoconductor element to a final substrate, such as paper, either by direct transfer or via an intermediate transfer material.

When multi-colored images are desired, one may apply each toner color to the photoconductor element and transfer each color image to the final substrate separately. Alternatively, as disclosed in copending U.S. patent application Ser. No. 08/537,296 filed Sep. 29, 1995, the multicolor image can be assembled during a single pass of a photoreceptor. Specifically, a photoreceptor is movably positioned in order that a given portion of the photoreceptor sequentially advances past a plurality of locations in a single pass. Any previously accumulated charge is erased from the photoreceptor. The photoreceptor is charged to a predetermined charge level. The photoreceptor is first image-wise exposed to radiation modulated in accordance with the image data for one of a plurality of colors in order to partially discharge the photoreceptor to produce an image-wise distribution of charges on the photoreceptor corresponding to the image data for the one of the plurality of colors. A first color liquid toner is applied to the image-wise distribution of charges on the photoreceptor to form a first color image. The photoreceptor is then exposed to radiation modulated in accordance with the image data for another of the plurality of colors in order to partially discharge the photoreceptor to produce an image-wise distribution of charges on the photoreceptor corresponding to the image data for the another of the plurality of colors in registration with the first color image. Such second image-wise exposing of the photoreceptor occurs without erasing the photoreceptor subsequent to the first image-wise exposing of the photoreceptor. A second color liquid toner is applied to the image-wise distribution of charges on the photoreceptor to form a second color image in registration with the first color image. The first and second color images are transferred together from the photoreceptor to the medium to form the multi-colored image.

Alternatively, a photoreceptor is rotated so that the following steps are performed in order. Any previously accumulated charge is erased from the photoreceptor. The photoreceptor is charged to a first predetermined charge level. The photoreceptor is first image-wise exposed to radiation modulated in accordance with the image data for one of a plurality of colors in order to partially discharge the photoreceptor to produce an image-wise distribution of charges on the photoreceptor corresponding to the image data for the one of the plurality of colors. A first color liquid toner is applied to the image-wise distribution of charges on the photoreceptor to develop the photoreceptor and form a first color image, the photoreceptor recharging as a result of this step to a second predetermined charge level, the second predetermined charge level being lower than the first predetermined charge level but being sufficiently high to subsequently repel liquid toner in areas not subsequently further discharged. The photoreceptor is second image-wise exposing, without erasing previously accumulated charge on the photoreceptor subsequent to the first image-wise exposing step, to radiation modulated in accordance with the image data for another of the plurality of colors in order to partially discharge the photoreceptor to produce an image-wise distribution of charges on a surface of the photoreceptor corresponding to the image data for the another of the plurality of colors in registration with the first color image. A second color liquid toner is applied to the image-wise distribution of charges on the photoreceptor to form a second color image in registration with the first color image. The first and second color images are transferred together from the photoreceptor to the medium to form the multi-colored image.

If further colors are desired, the first image-wise exposing step and first liquid toner application steps are repeated a total of three times corresponding to the first three color image planes of the multi-color image and then the second (now fourth) image-wise step and second (now fourth) toner application step is performed. All four color image planes are then transferred together from the photoreceptor to the medium to form the multi-colored image.

The structure of a photoconductor element may be a continuous belt, which is supported and circulated by rollers, or a rotatable drum. All photoconductor elements have a photoconductive layer which conducts electric current when it is exposed to activating electromagnetic radiation. The photoconductive layer is generally affixed to an electroconductive support. The surface of the photoconductor is either negatively or positively charged such that when activating electromagnetic radiation strikes the photoconductive layer, charge is conducted through the photoconductor in that region to neutralize or reduce the surface potential in the illuminated region. Other layers, such as priming layers or charge injection blocking layers, are also used in some photoconductor elements.

Typically, a positively charged toner is attracted to those areas of the photoconductor element which retain a negative charge after the imagewise exposure, thereby forming a toner image which corresponds to the electrostatic latent image. The toner need not be positively charged. Some toners are attracted to the areas of the photoconductor element where the charge has been dissipated. The toner may be either a powdered material comprising a blend of polymer and colored particulates, e.g. carbon to give black images, or a liquid material of finely divided solids dispersed in an insulating liquid. Liquid toners are often preferable because they are capable of giving higher resolution images.

The toner image may be transferred to the substrate or an intermediate carrier by means of heat, pressure, a combination of heat and pressure, or electrostatic assist. A common problem that arises at this stage of electrophotographic imaging is poor transfer from the photoconductor to the receptor. Poor transfer may be manifested by low transfer efficiency and low image resolution. Low transfer efficiency results in images that are light and/or speckled. Low image resolution results in images that are fuzzy. These transfer problems may be alleviated by the use of a release coating.

The release layer is applied over the photoconductive layer or over the interlayer. The release layer must not significantly interfere with the charge dissipation characteristics of the photoconductor construction. In addition, it is desirable to avoid beading of excess carrier liquid on the surface of the release layer because the beads of carrier liquid can disturb the toner image. When a multi-color image is formed on the photoconductor in a single pass without drying between imaging stages, such beading can cause diffraction of the exposing light during imaging resulting in lack of sharp lines or clarity in the final image. Further, the presence of the carrier on the surface may allow the toned image to continue to flow with adverse effects on image resolution. Therefore, there is a need for release layers which control the liquid on the surface of the photoreceptor and minimize the beading effect. Such release layers could also eliminate the need to dean the photoreceptor between images in multi-pass imaging or between single color images.

SUMMARY OF THE INVENTION

The present invention provides a photoconductor construction that yields improved image quality. The photoconductor construction comprises a release layer which controls the carrier liquid on the surface of the photoreceptor and minimizes beading of toner carrier liquid.

According to one embodiment this invention is a photoconductor construction comprising a photoconductor layer applied to an electroconductive substrate, an interlayer applied to the photoconductor layer, and a release layer over the interlayer. The release layer is a swellable polymer. By swellable is meant that the polymer is capable of absorbing carrier liquid in amounts greater than 60% of the weight of the polymer. The interlayer improves durability and increases useful life of the photoconductor element. The presence of the interlayer is particularly important in maintaining the integrity of swellable release layers.

According to another embodiment this invention is a photoconductor construction comprising a polymeric release layer that has a surface with an average roughness, Ra, of at least 10 nm. Preferably, an interlayer is present between the photoconductor layer and the release layer. The release layer may be a swellable or non-swellable polymer.

DETAILED DESCRIPTION OF THE INVENTION

The photoconductor construction of this invention comprises an electroconductive substrate which supports at least a photoconductor layer and a release layer. The photoconductors of this invention may be of a drum type construction, a belt construction, or any other construction known in the art.

Electroconductive substrates for photoconductive systems are well known in the art and are generally of two general classes: (a) self-supporting layers or blocks of conducting metals, or other highly conducting materials; (b) insulating materials such as polymer sheets, glass, or paper, to which a thin conductive coating, e.g. vapor coated aluminum, has been applied.

The photoconductive layer can be any type known in the art, including (a) an inorganic photoconductor material in particulate form dispersed in a binder or, more preferably, (b) an organic photoconductor material. The thickness of the photoconductor is dependent on the material used, but is typically in the range of 5 to 150 μm.

Photoconductor elements having organic photoconductor material are discussed in Borsenberger and Weiss, Photoreceptors: Organic Photoconductors, Ch. 9 Handbook of imaging Materials, ed. Arthur S. Diamond, Marcel Dekker, Inc. 1991. When an organic photoconductor material is used, the photoconductive layer can be a bilayer construction consisting of a charge generating layer and a charge transport layer. The charge generating layer is typically about 0.01 to 20 μm thick and includes a material which is capable of absorbing light to generate charge carriers, such as a dyestuff or pigment. The charge transport layer is typically 10–20 μm thick and includes a material capable of transferring the generated charge carriers, such as poly-N-vinylcarbazoles or derivatives of bis-(benzocarbazole)-phenylmethane in a suitable binder.

In standard use of bilayer organic photoconductor materials in photoconductor elements, the charge generation layer is located between the conductive substrate and the charge transport layer. Such a photoconductor element is usually formed by coating the conductive substrate with a thin coating of a charge generation layer, overcoated by a relatively thick coating of a charge transport layer. During operation, the surface of the photoconductor element is negatively charged. Upon imaging, in the light-struck areas, hole/electron pairs are formed at or near the charge generation layer/charge transport layer interface. Electrons migrate through the charge generation layer to the conductive substrate while holes migrate through the charge transport layer to neutralize the negative charge on the surface. In this way, charge is neutralized in the light-struck areas.

Alternatively, an inverted bilayer system may be used. Photoconductor elements having an inverted bilayer organic photoconductor material require positive charging which results in less deterioration of the photoreceptor surface. In a typical inverted bilayer system, the conductive substrate is coated with a relatively thick coating (about 5 to 20 μm) of a charge transport layer, overcoated with a relatively thin (0.05 to 1.0 μm) coating of a charge generation layer. During operation, the surface of the photoreceptor is positively charged. Upon imaging, in the light-struck areas, hole/electron pairs are formed at or near the charge generation layer/charge transport layer interface. Electrons migrate through the charge generation layer to neutralize the positive charge on the surface while holes migrate through the charge transport layer to the conductive substrate. In this way, charge is again neutralized in the light-struck areas.

As yet another alternative, an organic photoconductive layer can comprise a single-layer construction containing a mixture of charge generation and charge transport materials and having both charge generating and charge transport capabilities. Examples of single-layer organic photoconductive layers are described in U.S. Pat. Nos. 5,087,540 and 3,816,118.

Suitable charge generating materials for use in a single layer photoreceptor and/or the charge generating layer of a dual layer photoreceptor include azo pigments, perylene pigments, phthalocyanine pigments, squaraine pigments, and two phase aggregate materials. The two phase aggregate materials contain a light sensitive filamentary crystalline phase dispersed in an amorphous matrix.

The charge transport material transports the charge (holes or electrons) from the site of generation through the bulk of the film. Charge transport materials are typically either molecularly doped polymers or active transport polymers. Suitable charge transport materials include enamines, hydrazones, oxadiazoles, oxazoles, pyrazolines, triaryl amines, and triaryl methanes. A suitable active transport polymers is polyvinyl carbazole. Especially preferred transport materials are polymers such as poly(N-vinyl carbazole) and acceptor doped poly(N-vinylcarbazole). Additional materials are disclosed in Borsenberger and Weiss, Photoreceptors: Organic Photoconductors, Ch. 9 Handbook of Imaging Materials, ed. Arthur S. Diamond, Marcel Dekker, Inc. 1991.

Suitable binder resins for the organic photoconductor materials include, but are not limited to, polyesters, polyvinyl acetate, polyvinyl chloride, polyvinylidene chloride, polycarbonates, polyvinyl butyral, polyvinyl acetoacetal, polyvinyl formal, polyacrylonitrile, polyacrylates such as polymethyl methacrylate, polyvinyl carbazoles, copolymers of monomers used in the above-mentioned polymers, vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers and mixtures thereof. Suitable solvents used in coating the organic photoconductor materials include, for example, nitrobenzene, chlorobenzene, dichlorobenzene, trichloroethylene, tetrahydrofuran, and the like.

Inorganic photoconductors such as, for example, zinc oxide, titanium dioxide, cadmium sulfide, and antimony sulfide, dispersed in an insulating binder are well known in the art and may be used in any of their conventional versions with the addition of sensitizing dyes where required. The preferred binders are resinous materials, including, but not limit to, styrenebutadiene copolymers, modified acrylic polymers, vinyl acetate polymers, styrene-alkyd resins, soya-alkyl resins, polyvinylchloride, polyvinylidene chloride, acrylonitrile, polycarbonate, polyacrylic and methacrylic esters, polystyrene, polyesters, and combinations thereof. Inorganic photoconductors such as selenium, selenium/tellurium, and arsenic triselenide are also well known in the art.

According to the embodiment wherein carrier liquid effects on image quality are controlled and beading is minimized by controlling surface roughness, the release layer material may be any polymeric material known to be used as release layer for photoconductors, such as, for example silicones or fluoropolymers. Preferably, however, the release layer composition is a swellable polymeric material. The degree of roughness of the release layer must not be so high as to disturb print quality. Preferably, the average surface roughness, Ra, is less than 500 nm, more preferably less than 100 nm, most preferably less than 50 nm. The surface roughness, Ra, should be greater than about 10 nm to avoid beading of the carrier liquid. However, the precise minimum roughness will depend on surface energy and swellability characteristics of the release layer material. Preferably, the rough release layer is applied over an interlayer rather than being applied directly to the photoconductive layer.

Roughening can be achieved in a number of ways. A preferred method of creating roughness is to include particulates in the release formulation that act to roughen the surface. Preferably the amount of particulate fibers is from 0.01 to 20 weight %, more preferably 0.05 to 15 weight %, most preferably 0.1–10%, based on total weight of the release layer. If particulate fillers are added, low surface energy fillers are preferred. Low surface energy fillers are defined as those with a surface energy preferably less than 50 dynes/cm and more preferably less than 30 dynes/cm, as measured by a dynamic contact angle method, as described in P. C. Hiemenz, Principles of Colloid and Surface Chemistry (Marcel Dekker, Inc. New York, 2nd edition, pp. 335–338) using water as the polar test fluid and heptane as the fluid with the dispersive test fluid. The resulting surface energy was calculated using the method of D. K. Owens and R. C. Wendt (Journal of Applied Polymer Science, 1969, 13, pp. 1741–1747.

A non-limiting list of low surface energy fillers includes polymethylmethacrylate beads, polystyrene beads, silicone rubber particles, teflon particles, and acrylic particles. Other particulate fillers which can be used but which are higher surface energy include but are not limited to silica (not hydrophobically modified), titanium dioxide, zinc oxide, iron oxide, alumina, vanadium pentoxide, indium oxide, tin oxide, and antimony doped tin oxide. High surface energy particles that have been treated to lower the surface energy are useful. The preferred inorganic particles include fumed, precipitated or finely divided silicas. More preferred inorganic particles include colloidal silicas known under the tradenames of CAB-O-SIL (available from Cabot) and AEROSIL (available from Degussa). Suitable low surface energy inorganic fillers include surface treated colloidal silica fillers such as CAB-O-SIL TS-530 and TS-720, Degussa R812, R812S, and P.202. CAB-O-SIL TS-530 is a high purity treated fumed silica which has been treated with hexamethyldisilazane (HMDZ). CAB-O-SIL TS-720 treated fumed silica is a high purity silica which has been treated with a dimethyl silicone fluid. The treatment replaces many of the surface hydroxyl groups on the fumed silica with a polydimethyl siloxane polymer. The treatment replaces many of the hydroxyl groups on the fumed silica with trimethylsilyl groups. As a result the silica is a low surface energy particle.

Non-conductive fillers are preferred. When conductive fillers are used, the electrical characteristics of the photoconductive assembly must be considered in order to avoid adverse effects due to lateral conductivity. Preferably, the amount of conductive particulate filler should be low enough that the particles do not act as conductors.

Particle size recommended depends on the degree of roughness desired and the thickness of the release layer. For most release layers, fillers having mean volume average diameter from 10 to 50,000 nm, preferably 50 to 5000 nm may be used. The average surface roughness, Ra, as defined by phase shift interferometry, should be greater than about 10 nm in order to improve image quality. However, the precise minimum roughness may depend on surface energy characteristics and swellability of the release layer material.

According to the embodiment wherein the release layer is a swellable polymer, the release layer preferably is formed by cross linking a high molecular weight functionally terminated siloxane. More preferably, the release layer is the reaction product of a high molecular weight functionally terminated siloxane, a low molecular weight functionally terminated siloxane, and a cross-linking agent. If such a combination is used, the weight ratio of high molecular weight functionally terminated siloxane to low molecular weight functionally terminated siloxane is preferably in the 0.1:100 to 100:1, more preferably 1:1 to 20:1. Examples, of functional terminal groups include but are not limited to hydroxy, vinyl, alkenyls of 2–20 carbon atoms, hydride, ethoxy, methoxy, and ketoxime. Hydroxy terminal groups are preferred. The high molecular weight functionally terminated siloxane preferably has at least 2500 repeating units, more preferably 3000–8000 repeating units. Syloff™ 23 from Dow Coming Corp. is a commercially available example of a product comprising primarily a high molecular weight functionally terminated siloxane. The low molecular weight hydroxy terminated siloxane preferably has no more than 1000 repeating units, more preferably 100 to 500 repeating units. PS342.5 from United Chemical Technologies, Inc. is a commercially available example of a suitable low molecular weight hydroxy terminated siloxane. Suitable cross linkers include hydride crosslinkers such as NM203 from United Chemical Technologies, Inc.

When such a swellable release layer is used, the Inventors have found that an interlayer must also be used to achieve satisfactory degree of adhesion between the release layer and the photoconductive layer and to attain a mechanically durable system. The swollen release layer has reduced strength and is more easily abraded or delaminated. The interlayer is necessary to compensate for that reduced strength.

If desired, both methods may be used together to manage the carrier liquid on the photoreceptor surface, i.e. use a swellable material in forming a release layer that has a surface roughness, Ra, between about 10 nm and 500 nm.

Preferably the thickness of the release layer is greater than 0.3 μm. The maximum thickness is dependent on the photoconductor material, but preferably the thickness is in the range of 0.4 to 3 μm, more preferably 0.5 to 1 μm. A thicker layer as indicated is necessary to provide a mechanically durable photoreceptor when a swellable polymer is used as a primary component of the release layer. Durability is particularly important when transfer of the image from the photoconductor element to the image receiver is accomplished primarily by heat and pressure and without electrostatic assist because the heat and pressure can be very harsh on the surface layer of the photoconductor element.

The photoconductor element of this invention further comprises an interlayer between the photoconductor layer and the release layer. The interlayer improves the adhesion of the release layer to the photoconductor layer. The interlayer preferably protects the photoconductor layer from the toner carrier liquid and other compounds which might damage the photoconductor. The interlayer preferably also protects the photoconductive layer from damage that could occur from charging the photoconductor element with a high voltage corona. The interlayer, like the release layer, must not significantly interfere with the charge dissipation characteristics of the photoconductor element and must adhere well to the photoconductive layer and the release layer, preferably without the need for adhesives. The interlayer may be any known interlayer, such as a crosslinkable siloxanol-colloidal silica hybrid as disclosed in U.S. Pat. Nos. 4,439,509; 4,606,934; 4,595,602; and 4,923,775; a coating formed from a dispersion of hydroxylated silsesquioxane and colloidal silica in an alcohol medium as disclosed by U.S. Pat. No. 4,565,760; or a polymer resulting from a mixture of polyvinyl alcohol with methylvinylether/maleic anhydride copolymer. Preferably the interlayer is a composite which includes silica and an organic polymer selected from the group consisting of polyacrylates, polyurethanes, polyvinyl acetals, sulfonated polyesters, and mixtures of polyvinyl alcohol with methylvinylether/maleic anhydride copolymer. The organic polymer and silica are preferably present in the interlayer at a silica to polymer weight ratio ranging from 9:1 to about 1:1. Interlayers of this type are disclosed in copending U.S. Application Ser. No. 08/091,999 filed Jul. 15, 1993 (corresponding to EPO 0 719 426). Another preferred interlayer is a composite material of an organic polymer with a silanol. The silanol has the formula $$YaSi(OH)b$$

wherein:

Y includes, for example, alkyl or alkoxy groups having from 1 to 6 carbon atoms; alkoxyalkyl groups in which the alkoxy portion contains from 1 to 2 carbon atoms and the alkyl portion contains from 1 to 6 carbon atoms; halogenated alkyl groups having from 1 to 6 carbon atoms and from 1 to 2 halogen substituents; aminoalkyl groups having from 1 to 6 carbon atoms and one amino group attached to either the 2, 3, 4, 5 or 6 carbon atom; a vinyl group; a phenyl group which may contain 1 to 2 halogen substituents; a cycloalkyl group having from 5 to 6 carbon atoms and which may contain 1 to 2 substituents; and hydrogen, a is a number ranging from 0–2, b is a number ranging from 2–4, and a plus b equals 4.

The organic polymer is preferably selected from the group consisting of polyacrylates, polyurethanes, polyvinyl acetals, sulfonated polyesters, and mixtures of polyvinyl alcohol with methylvinylether/maleic anhydride copolymer.

Other layers, such as primer layers, substrate blocking layers, etc. as are known in the art may also be included in the photoconductor construction.

EXAMPLES

The following non-limiting examples are provided to illustrate the invention.

The following release layer formulations were prepared:

Formulation I: 10 parts by weight Syloff™ 23 (15% by weight in heptane) and 0.1 parts by weight Syloff™ 23A.

Formulation II: 25 parts by weight Syloff™ 23 (at 5% by weight in heptane), 25 parts by weight Q2-7075 (hydroxy terminated dimethylsiloxane at 5% in solution from Dow Coming Corp.), 0.36 parts Syloff™23A, 0.18 parts Syloff™297 (glycidoxypropyltrimethoxysilane, vinyl triacetoxysilane), and 50 parts heptane.

Formulation III: 7.5 parts 15% Syloff™23, 0.28 parts PS342.5, 0.09 parts NM203, 38.84 parts heptane, 0.16 parts 1% Pt catalyst (0.15 wt % Pt coordinated with 0.85% tetra vinyl disiloxane in heptane)

Formulation IV: 5 parts 15% Syloff™23, 0.56 parts PS342.5, 0.19 parts NM203, 40.96 parts heptane, 0.16 parts 1% Pt catalyst (0.15 wt % Pt coordinated with 0.85% tetra vinyl disiloxane in heptane)

Formulation V: 5 parts 15% Syloff™23, 0.56 parts PS342.5, 0.19 parts NM203, 0.16 parts 1% Pt catalyst, 0.08 parts T-1 SnO2/SbO electroconductive powder from Konishi International, Inc., 43.42 parts heptane Formulation VI: 0.9 parts PS342.5, 0.3 parts NM203, 20 parts heptane, 0.1 parts 1% Pt catalyst Formulation VII: 3.8 g Vinylmethyl dimethylsiloxane copolymer* (trimethylsiloxy terminated having a 10.38 mole % vinylmethyl; 15% by weight in heptane), 1.2 g C-158 (vinylmethyl dimethyl-siloxane copolymer, trimethylsiloxy terminated having 0.2 mole % vinylmethyl, available from Wacker Silicones; 15% by weight in heptane), 0.2 g NM203 (polymethylhydrosiloxane, available from Huls America), 20.0 g Heptane, 0.1 g Platinum catalyst (0.15 wt% Pt coordinated with 0.85% tetra vinyl disiloxane in heptane). * The siloxane copolymer was prepared by using the method described in McGrath, I. E., and I. Yilgor, Adv. Polymer Science, vol. 86, p. 1, 1989.

Formulation VIII: Formulation VII plus 1.7% by weight of solids of SnO2/SbO electroconductive powder from Konishi International Inc.

Formulation IX: Formulation VII plus 3.4% by weight of solids of SnO2/SbO electroconductive powder from Konishi International Inc.

Formulation X: Formulation VII plus 5.8% by weight of solids of SnO2/SbO electroconductive powder from Konishi International Inc.

Formulation XI: 84 parts Dow Corning 7695, 14 parts Dow Coming 7048, 2 parts Dow Coming 2-7113, 125 ppm Syloff4000 delivered as 6.3% solids in heptane.

Formulation XII: Same as Formulation XI with the inclusion of 0.8 parts Cab-O-Sil TS720.

The above release formulations were coated on to a photoconductor substrate using ring, slot or slide coating techniques. The ring coating process used is described in Borsenberger, P. S. and D. S. Weiss, Organic Photoreceptors for Imaging Systems, Marcel Dekker, Inc., New York, 1993, p. 294. Slot and slide coating techniques are described by E. Cohen and E. Gutoff in Modern Coating and Drying Technology, VCH Publishers, Inc. New York, 1992, pp. 117–120.

Norpar™ 12 Durability Wiper Test

The Norpar™ 12 durability wiper consisted of a 6.25" (15.9 cm) diameter aluminum drum and 5 stainless steel shoes with concave surfaces having radii to match the drum. The drum was positioned horizontally and attached to a gear and motor which enabled rotation of the drum at a speed of 40 rev/min. The 5 stainless steel shoes rested, by their own weight (about 300 g), concave side down, on the top side curve of the drum. The shoes were held in place so that they did not move with the rotation of the drum, but could move vertically. Two layers of paper toweling were wrapped around the drum and then soaked with Norpar™ 12. One 1.25"×4" (3.175 cm×10.16 cm) strip of the photoconductor construction was secured onto the curved surface of each metal shoe so that, when the shoes were in place, the release surface was in contact with the paper toweling. The drum was then rotated at 40 rev/min for 800 revolutions. For samples with more than 800 wiping revolutions, the paper toweling was replaced by fresh Norpar™ 12 soaked toweling every 800 revolutions. After wiping, the sample strips were air dried at least overnight before peel tests or ink electroplating was done.

Peel Test to Measure Release Force

Slip/peel tester model SP-102B-3M90 from Instrumentors, Inc. was utilized for tape peel force measurements. The 1.25"×4" (3.175 cm×10.16 cm) sample strips were each affixed to the working platen with double stick tape. 3M 202 masking tape, 1"(2.54 cm) wide, was applied to the sample release surface or ink surface electroplated on a release surface (see below) and a 15 lb. (6.8 kg) roller was rolled over the tape 6 times. Immediately after adhering the tape, an MB-10 lead cell was used to measure the average force (g/in which is then converted to g/cm) required to peel the tape or the tape/ink combination off the surface at 180o and 90"/min (228.6 cm/min) for 2 seconds.

Swell Test

Formulations at 5–10% solids in heptane were placed in an aluminum weighing parts covered with teflon tape. The solvent was allowed to evaporate overnight in a vented hood before the sample was heated in an oven at 150° C for 10 minutes. The dried, cured films were removed from the parts, weighed to determine unswollen weight, and then soaked in Norpar™ 12 for 24 hours. After removal from Norpar™ 12, the film surfaces were patted dry and weighed. The % swell is the weight after soaking minus the unswollen weight divided by the unswollen weight.

Example 1

The above dried and cured formulations were tested for swelling with Norpar™12 (from Exxon). The % swell as indicated by the % increase in the weight of the release polymer sample are as follows:

Formulation I: 320%
Formulation II: 315%
Formulation III: 165%
Formulation IV: 90%
Formulation VI: 35%
Formulation VII: 17%
Formulation XI: 42%

Example 2

The above release formulations II and IV were ring coated directly onto an organic inverted dual layer organic photoconductor, i.e. without an interlayer.

The inverted dual layer photoconductor produced as follows onto an aluminized polyester film as follows:

To 1000 gm of 12.5% polycarbonate Z (Mitsubishi Gas Co.)/PE 2200 (Shell Chemical Co.) (99:1) in toluene was added 62.5 gm 9-ethylcarbazole-3-aldehyde-N-methyl-N-phenyl-hydrazone and 62.5 gm 9-ethylearbazole-3-aldehyde-N,N-diphenyl-hydrazone. This mixture was dissolved and coated onto aluminized polyester film and dried to afford a 8.75 micron charge transport layer. On top the charge transport layer was coated a 4.0% solids dispersion of(1:1) x-form-metal-free phthalocyanine (Zeneca, Ltd)/S-lee Bx-5 (Sekisusi Chemical Co.) to afford a 0.3 micron dried charge generation layer.

The thickness of the release layers was in every case greater than 0.3 μm.

The peel force in grams/in after the release layer was wiped with Norpar™ 12 for 1600 passes were 95 g/cm and 140 g/cm respectively. In some areas the entire construction was wiped from the substrate indicating unacceptable adhesion levels when no interlayer is used.

Example 3

Formulations I–IV were coated onto a single layer organic photoconductive material:

Organic Photoconductive layer coating solution: Millbase:

| | |
|---|---|
| X-form metal free Phthalocyanine pigment (available from Zeneca Corp.) | 100 g |
| EC-130 (vinyl chloride copolymer, available from Sekisui; 15% by weight in tetrahydrofuran) | 400 g |
| Mowital ™ B60HH (polyvinylbutyral resin, available from Hoechst Celanese; 15% by weight in tetrahydrofuran) | 600 g |
| Tetrahydrofuran | 1000 g |

The materials listed above were mixed together in a 1 gallon (3.78 1) glass bottle. The mixture was then milled in a 250 mL horizontal sandmill with 0.8 mm ceramic milling media for 20 hours at a rotor speed of 4,000 rpm.

A coating solution was then prepared by mixing the following materials:

| | |
|---|---|
| Millbase prepared above (12.4% by weight in THF) | 4230 g |
| Tinuvin-770 ™ (UV stabilizer, available from Ciba Geigy) | 36 g |
| Mowital ™ B60HH (15% polyvinylbutyral resin in THF, available from Hoechst Celanese) | 5154 g |
| Tetrahydrofuran (THF) | 1731 g |

The materials listed above were mixed thoroughly together and filtered through a 5 micron absolute filter (available from Porous Media Corp.). Just prior to coating, 14.5 g of Mondur CB-601 (available from Mobay Corp.), 0.87 g of Dibutyl tin dilaurate and 58 g of THF were added to 1700 g of the filtered solution described above. The final coating solution was extrusion coated onto 0.1 mm (4 mils) aluminum vapored coated polyester and air dried at 182° C. (360° F.) for 1 minute, resulting in a dry coating thickness of 7.5 microns.

The photoconductor construction also had an interlayer which had the following formulation:

| | |
|---|---|
| 3-Glycidoxypropyltrimethoxysilane (from Huls America Inc.) | 0.15 g |
| Nalco ™2326 (14.5% colloidal silica in water, available from Nalco Chemical) | 3.1 g |
| Deionized water | 6.5 g |
| Triton ™ X-100 surfactant (from Union Carbide Chemicals & Plastics Co.) | 0.02 g |
| Polymer solution (2.4 parts Elvanol ™ 50-42 PVA from DuPont, 0.2 parts Gantrez ™ AN-169 methylvinylether/maleic anhydride copolymer from GAF Corp., and 98.4 parts water) | 22.3 g |

The release layers were in each case greater than 0.3 μm. After 3200 Norpar™ wipes all samples had peel forces in the range of about 12–16 g/cm. Other tests have indicated that when a Syloff 23 release coating was coated in thickness less than 0.3 μm the peel force after Norpar™ wipes increases significantly to values in the range of about 400 g/cm.

Example 4

Formulations II and III–V were coated on the dual layer photoconductive material disclosed in Example 2. However, in this case the interlayer, made from 325.4 g of 6% S-lee Bx-5 (from Sekisusi Chemical Co. in MeOH), 1395 g isopropyl alcohol (IPA), 50 g Nalco 1057 colloidal silica, 49.5 g 5% Z-6040 silane (Dow Corning 50/50 in IPA/H2O), 194.6 g 1.5% Gantrex AN-169 Polymer (ISP Technologies 50/50 in MeOH/H2O), was used between the photoconductive layer and the release layer. After 3200 Norpar™ wipes the peel force (g/cm) was as follows:

Formulation II: 7.9

Formulation III: 14

Formulation IV: 12

Formulation V: 7.5

Example 5

Print quality using magenta toner or black toner as described in Example 40 of co-pending U.S. patent application No. 08/536, 856, filed Sep. 29, 1995, was tested for all the above release layer Formulations. The process of imaging was like the process disclosed in U.S. patent application No. 08/537,296, except that the images were allowed to dry in air for about 1 minute before transfer of the image to plain paper.

The photoconductor construction for formulations I–IV and VI had a single layer photoconductive layer of the formulation set forth in Example 3 except that it was ring coated on a metal drum. The interlayer had the formulation:

| | |
|---|---|
| 3-Glycidoxypropyltrimethoxysilane (5% solids in a 50/50 mixture of water and 2-propanol available from Huls America Inc.) | 10.0 g |

-continued

| | |
|---|---|
| Nalco ™1057 (30% colloidal silica in 2-propoxyethanol, available from Nalco Chemical) | 16.0 g |
| 2-propanol available from Union Carbide Chemicals & Plastics Co.) | 176.0 g |
| Polyvinylbutyral (5% solids in a mixture of 2-propanol and ethanol 70/30, available from Sukisui Chemical Co. Ltd.) | 48.0 g |

The photoconductor construction for formulation V was like that in Example 4.

Formulations I–V showed good print quality, while Formulation VI which has low swell showed fair to poor print quality. Print quality was evaluated by observing the print for the following characteristics: text characters indistinctly defined or surrounded by a halo of toner, text characters exhibiting broadening of individual pixels, defects from drag of toner caused by the rotation of the developer rolls or the squeegee rolls, missing portions of the image due to transfer of the toner to the squeegee roll during image development. Prints exhibiting little or no evidence of these defects were rated good to excellent. Prints with some evidence of deterioration of image quality as described above were rated fair. Prints exhibiting a large number and extent of problems were rated as poor.

Example 6

A silicone polymer cross-linked through vinyl functionalities was coated onto a photoconductor construction as used for formulations I–IV and VI in Example 5. The surface roughness was varied as indicated below. Single pass images in a single color were made using the photoconductor constructions and magenta toner. In addition, the constructions were tested as in Example 2 for peel force after 3200 Norpatrol2 wipes. Roughness was measured on a Wyko HI-RES Interferometer which uses phase shift interferometry. Average roughness, Ra, is recorded below. The results below demonstrate that the release layers with a slightly rough surface provide better image quality.

| Formulation | Ra (nm) | Peel force (g/cm) | Print Quality |
|---|---|---|---|
| VII | 1.51 | 8.7 | poor |
| VIII | 6.23 | 6.3 | poor |
| IX | 14.8 | 6.3 | good |
| X | 15.2 | 5.9 | good |

Example 7

A crosslinked silicone polymer with the following % by weight of CAB-O-SIL TS720 (low surface energy silica from Cabot Corp.) were evaluated for print quality as described in previous examples. Roughness was measured as in Example 6.

| Formulation | % filler | Ra (nm) | Print Quality |
|---|---|---|---|
| XI | 0 | 6.2 | fair |
| XII | 1 | 117.4 | good |

This Example shows the improvement in print quality as roughness is increased.

What is claimed is:

1. A photoconductor element comprising an electroconductive substrate, a photoconductive layer on one surface of the electroconductive substrate, an interlayer over the photoconductive layer, and over the interlayer, a release layer having a thickness greater than 0.3 μm, wherein the release layer comprises a swellable polymer.

2. The element of claim 1 wherein the release layer comprises a silicone polymer which is the reaction product of components comprising a high molecular weight siloxane with terminal functional group, a low molecular weight siloxane with terminal functional group, and a crosslinking agent.

3. The clement of claim 2 wherein the terminal functional group is hydroxy.

4. The element of claim 1 wherein the release layer has a surface roughness greater than about 10 nm.

5. The element of claim 4 wherein the surface roughness is less than 500 nm.

6. The element of claim 1 in which the photoconductive layer is an inverted dual layer photoconductor.

7. A photoconductor element for liquid electrophotography comprising an electroconductive substrate, a photoconductive layer on one surface of the electroconductive substrate, and as an outerlayer over the photoconductive layer, a polymeric release layer having a surface roughness, Ra, greater than 10 nm, wherein the release layer consists essentially of particulate fillers and a primary material selected from the group consisting of fluoropolymers and silicones.

8. The photoconductor element of claim 7 wherein the surface roughness of the release layer is less than 500 nm.

9. The photoconductor element of claim 7 further comprising an interlayer between the release layer and the photoconductive layer.

10. The photoconductor element of claim 7 wherein the particulate fillers are non-conductive.

11. The photoconductor element of claim 7 wherein the particulate fillers are selected from the group consisting of polymethylmethacrylate beads, polystyrene beads, silicone rubber particles, teflon particles, acrylic particles, silica, titanium dioxide, zinc oxide, iron oxide, alumina, vanadium pentoxide, indium oxide, tin oxide, and antimony doped tin oxide.

12. The photoconductor element of claim 7 wherein the particulate fillers are low surface energy fillers.

13. The photoconductor element of claim 12 wherein the surface energy of the fillers is less than 50 dynes/cm.

14. The photoconductor element of claim 12 wherein the low surface energy fillers are selected from the group consisting of polymethylmethacrylate beads, polystyrene beads, particles of silicone rubber, teflon particles, acrylic particles, and hydrophobically modified silica.

15. The photoconductor element of claim 7 wherein the release layer comprises the particulate fillers in a silicone.

16. The photoconductor element of claim 7 wherein the release layer comprises the particulate fillers in a swellable polymer.

17. The photoconductor element of claim 7 wherein the particulate fillers are present in amounts from 0.01 to 20 weight % based on total weight of the release layer.

18. A photoconductor element for liquid electrophotography comprising an electroconductive substrate, a photoconductive layer on one surface of the electroconductive substrate, and as an outerlayer over the photoconductive layer, a polymeric release layer having a surface roughness, Ra, greater than 10 nm and less than 500 nm, wherein the release layer consists essentially of a material selected from fluoropolymers and silicones.

19. A method of forming an image comprising providing the photoconductor element of claim 7 applying a charge to the photoconductor element, exposing the charged photoconductor element to activating radiation in an imagewise manner, developing the resulting electrostatic latent image with a liquid toner comprising toner particles in a carrier liquid, and transferring the developed image to a final substrate.

* * * * *